United States Patent [19]

Dumbser

[11] Patent Number: 4,832,332

[45] Date of Patent: May 23, 1989

[54] DIGITAL INDICATING INSTRUMENT FOR A PHYSICAL TRAINING DEVICE

[75] Inventor: Gerhard Dumbser, Niederwerrn, Fed. Rep. of Germany

[73] Assignee: Fichtel & Sachs AG, Fed. Rep. of Germany

[21] Appl. No.: 157,513

[22] Filed: Feb. 17, 1988

[30] Foreign Application Priority Data

Feb. 24, 1987 [DE] Fed. Rep. of Germany ..... 3705796

[51] Int. Cl.[4] ..... A63B 69/06

[52] U.S. Cl. ..... 272/72; 272/73; 272/69; 272/70; 272/DIG. 4; 272/DIG. 5; 272/DIG. 6; 73/379

[58] Field of Search ..... 272/69, 70, 72, 73, 272/DIG. 4, DIG. 5, DIG. 6; 73/379

[56] References Cited

U.S. PATENT DOCUMENTS

| | | | |
|---|---|---|---|
| 4,278,095 | 7/1981 | Lapeyre | 272/69 X |
| 4,358,105 | 11/1982 | Sweeney, Jr. | 272/DIG. 5 X |
| 4,378,111 | 3/1983 | Tsuchida et al. | 272/69 X |
| 4,436,097 | 3/1984 | Cunningham | 272/73 X |
| 4,512,566 | 4/1985 | Bicocchi | 272/73 X |
| 4,632,570 | 12/1986 | Kelsey | 368/107 |
| 4,705,268 | 11/1987 | Nadeau | 272/72 |
| 4,714,244 | 12/1987 | Kolomayets et al. | 272/72 |

FOREIGN PATENT DOCUMENTS

| | | | |
|---|---|---|---|
| 2114901 | 9/1983 | United Kingdom | 272/73 |

*Primary Examiner*—Richard J. Apley
*Assistant Examiner*—Joe H. Cheng
*Attorney, Agent, or Firm*—Toren, McGeady & Associates

[57] ABSTRACT

A digital indicating instrument for a physical training device, in particular a rowing device, includes a sensor fixed rigidly to a basic frame of the training device and sensor trip element fixed to an operating part, in particular to a sliding seat of the rowing device. An evaluation circuit responds to control pulses generated by the sensor during the passing movement of the trip element and determines together with the training time output-related data, which are displayed on a display screen. A training time measuring device is started by control pulses of the sensor for an automatic determination of the training time. A stop device stops the training time measuring device if within a preset time interval no control pulse is generated by the sensor. A suppressor suppresses at the start of training at least the first control pulse, in order to prevent unintentional starting of the training time measuring device.

8 Claims, 2 Drawing Sheets

DIGITAL INDICATING INSTRUMENT FOR A PHYSICAL TRAINING DEVICE

BACKGROUND OF THE INVENTION

The invention concerns a digital indicating instrument for a physical training device.

Physical training devices, such as rowing devices or home bicycles for example, have a basic frame on which is movably guided an operating part, for example two oar handles or a pair of pedal cranks, which moves against an adjustable resistance for the training. It is known with such a physical training device to record movement of a trip element fixed to the operating part by means of a sensor attached to the basic frame and to determine data signals by means of an evaluation circuit responding to control pulses generated by the sensor which represent the output produced during the training. The data are displayed on a display screen of the evaluation circuit.

The data representing the training output also particularly include the training time. The indicating instrument should therefore include a time measuring device which records in real time the actual training time minus any pauses, i.e. the time interval in which the operating part is actually moved and the sensor emits control pulses.

It could be considered to provide a stop-watch in the indicating instrument, operable for example by start and stop buttons. This would have the disadvantage, however, that the stop-watch has to be operated continuously during the training.

SUMMARY OF THE INVENTION

It is an object of the invention to provide a digital indicating instrument for a physical training device which determines the actual training time automatically and also ensures that measuring errors are avoided in the start-up of the physical training device.

The indicating instrument according to the invention comprises a controller responding to control pulses and a training time measuring device controllable in a start-stop operation. The signal of the training time measurement device is displayed by the display screen and represents the training real time. The training time measuring device is started by control pulses occurring at the start of training. The controller stops the training time measuring device if within a time interval of a preset length a control pulse is not followed by a further control pulse. In this way the training time is measured only if the operating part is moved at a speed at which the control pulses generated by the sensor succeed each other with a cycle shorter than the preset time interval. The length of the preset time interval is governed by the nature of the physical training device, for example for a rowing device the interval is preset according to a minimum oar-stroke rate of ten strokes per minute.

Normally the operating part of the training device is moved while the person training is taking up position on the device for the subsequent training. In order to prevent measuring errors by the training time measuring device caused by this initial and often unintentional movement, the controller suppresses a preset number of control pulses when the training time measuring device is stopped, which leads to a delayed start of the training time measuring device defined by the number of control pulses suppressed. Therefore, initial control pulses, that can occur for example during the start-up of the training device, do not trigger the training time measuring device. The measuring error caused by the delayed start is however negligible, as the training time measuring device continues to run beyond the last control pulse by the time interval monitored by the controller and thus the delay is always less than this time interval.

A preferred embodiment of the invention comprises an evaluation circuit including a pulse rate measuring device which output a signal that is displayed by the display screen and represents the repetition rate of the control pulses. In order to prevent a distorted value due to the start-up being displayed at the start of training, it is also provided that when the training time measuring device is stopped the control circuit suppresses a preset number of control pulses and thus provides a delayed measurement.

For both the training time measuring device and for the pulse rate measuring device, the controller suppresses the first control pulse succeeding the initial or the repeated start-up pulse. The start of the training time measuring device can however in individual cases also take place after the pulse rate measuring device starts to measure, for example if pairs of control pulses are assigned to the data to be determined by the evaluation circuit. For example, in order to simplify the design, there is monitored in a rowing device not the movement of the oar handles, but the movement of the sliding seat provided with such a device. For each complete oar stroke, however, the sensor generates two control pulses. In order to make the oar stroke count coincide with the training time, it is provided that whereas the pulse rate measuring device starts to measure with the second control pulse after the start of training, the training time measuring device and where applicable a counter counting the number of oar strokes is started with the third control pulse.

A resetting device operated by a reset button can be provided for the resetting of data which have been determined. An unintentional erasing of data can be prevented if means are provided to ensure that the reset button has to be actuated for a preset time interval, for example two seconds or longer.

The various features of novelty which characterize the invention are pointed out with particularity in the claims annexed to and forming a part of this disclosure. For a better understanding of the invention, its operating advantages and specific objects attained by its use, reference is made to the accompanying drawings and descriptive matter in which there are illustrated and described preferred embodiments of the invention.

DETAILED DESCRIPTION OF THE DRAWINGS

Figure 1:
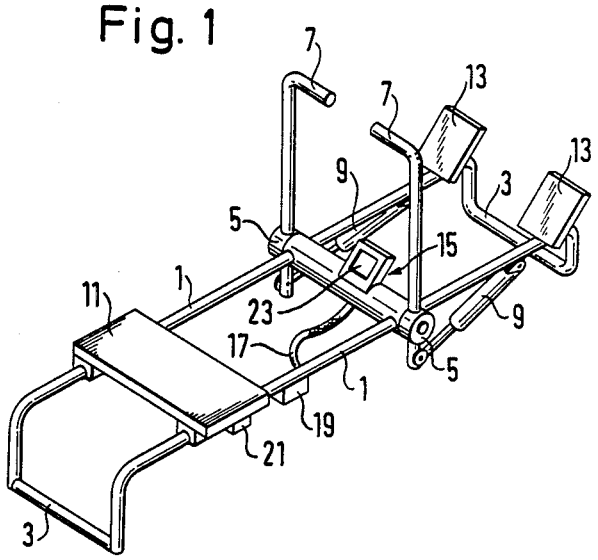
FIG. 1 is a perspective view of a rowing device with a digital indicating instrument according to the invention.

A rowing device according to FIG. 1 has a basic frame formed by longitudinal struts 1 and transverse struts 3, on which two oar handles 7 are pivotally mounted by articulations 5. The swivelling movement of the oar handles 7 is retarded with preset resistance by adjustable, for example hydraulic brakes 9. A sliding seat 11 is mounted movably on the longitudinal struts 1. A person training takes up position for training on the sliding seat 11 and supports himself with his feet on foot plates 13, while at the same time moving the oar handles 7. With each oar stroke the sliding seat 11 executes a forward and backward movement.

A digital indicating instrument 15 is attached to the basic frame within view of the person training. The indicating instrument has an evaluation circuit explained in greater detail below, which is connected by a cable 17 with a sensor 19 attached to one of the longitudinal struts 1. The sensor 19 is designed as a magnetic field sensor, for example as a Reed switch, and responds to the passing movement of a magnet 21 fitted to the sliding seat 11. On both the forward movement of the sliding seat 11 and on its backward movement the sensor 19 responding to the magnet 21 causes a control pulse to be generated. The evaluation circuit of the indicating instrument responds to the control pulses and determines in dependence on the control pulses the total number of oar strokes executed, the instantaneous oar stroke frequency or oar stroke rate and the actual training time minus any pauses. These data are displayed numerically on a display screen 23 of the indicating instrument 15.

Figure 2:
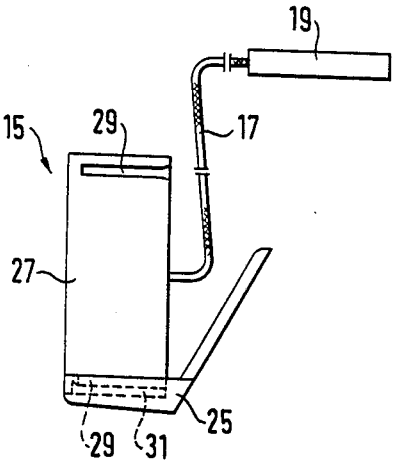
FIG. 2 is a side view of the indicating instrument.
Figure 3:
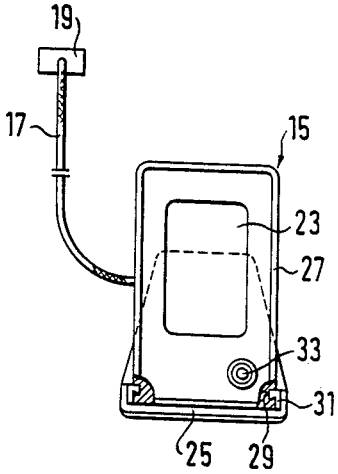
FIG. 3 is a front view of the indicating instrument.

FIGS. 2 and 3 show details of the indicating instrument which is detachably mounted in an angled holder 25 fixed to the basic frame of the rowing device. On the outside of a casing 27 of the indicating instrument 15, grooves 29 are provided in which ribs 31 tip-stretched to the angled holder 25 engage. As FIG. 2 shows, the casing 27 has several sets of such grooves 29, in order to provide free choice in the arrangement of the angled holder 25 when the rowing device is subsequently fitted with the indicating instrument. FIG. 3 shows that the indicating instrument has on its front side a reset button 33 by which all the data to be displayed can be erased.

Figure 4:
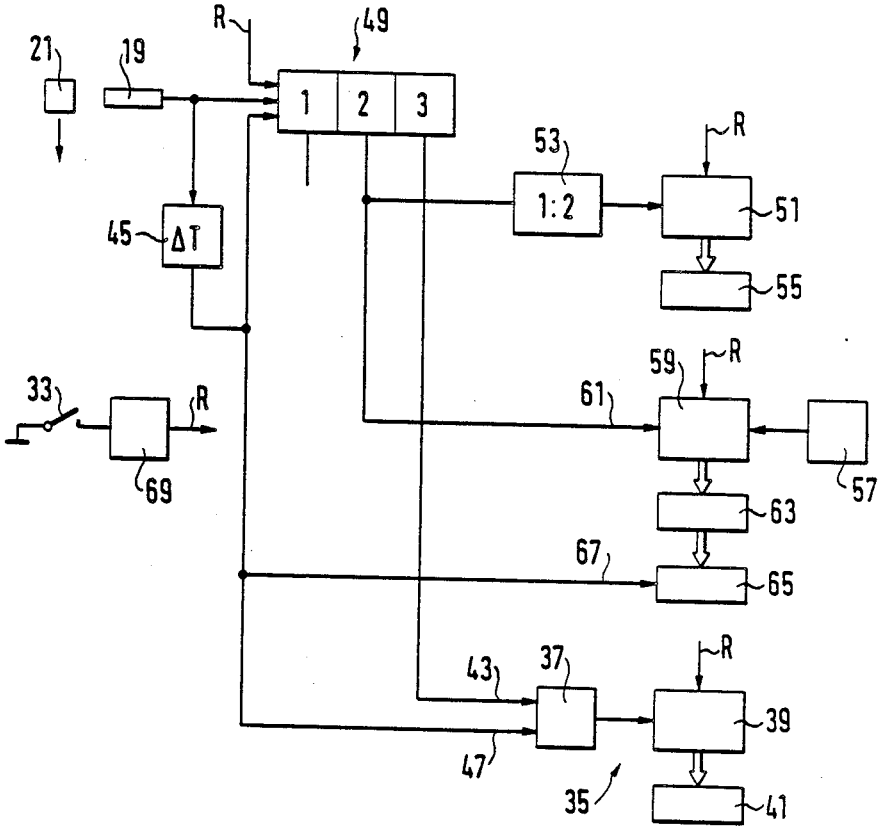
FIG. 4 is a block diagram of the indicating instrument.

FIG. 4 shows a block diagram of the evaluation circuit of the indicating instrument 15. The evaluation circuit permits an automatic determination of the actual training time minus any pauses. To this end, a training time measuring device 35 is provided with a counter 39 counting periodic timing pulses of a timing circuit 37, the reading of said counter being a measure of the elapsed training time in real time and being displayed in a display field 41 of the display screen 23 (FIG. 1). The training time measuring device 35 is controllable in a start-stop manner and is started by a control pulse generated in response to the sensor 19 responding to the magnet 21, said control pulse being fed to a start input 43 of the timing circuit 37. A switch-off device 45 (for example in the form of a monoflop retriggerable by the control pulses) responding to the control pulses of the sensor 19 supplies a stop signal to a stop input 47 of the timing circuit 37 if within a preset time interval $\Delta T$ the last occurring control pulse is not succeeded by a further control pulse. The time interval $\Delta T$ defines a preset minimum oar stroke rate. for a minimum oar stroke rate of ten strokes per minute the control pulses generated both during the forward and during the backward movement of the sliding seat 11 (FIG. 1) must succeed each other in a time interval $\Delta T$ of less than three seconds. The training time measuring device 35 is therefore stopped if rowing has stopped or is proceeding at a rate less than the minimum oar-stroke rate.

In order to be able to take up position on the rowing device according to FIG. 1, the person training generally has to bring the sliding seat 11 into one of its end positions. In order to prevent the control pulses generated by the sensor 19 from starting the training time measuring device 35 prematurely, the control pulses are fed to the start input 43 by a suppressor 49, for example in the form of a shift register. The shift register 49 as shown in the drawings has three stages the start input 43 being connected to the third stage. The shift register 49 is cancelled by stop signals of the shut-off device 45, so that at the start of training the control pulses generated by the sensor 19 have to migrate stepwise through the shift register 49 in time with the generated control pulses before they appear at the output of the third stage and can start the training time measuring device 35. The shift register 49 thereby suppresses the first two control pulses. Whereas the first suppressed control pulse can be caused by an unintentional movement of the sliding seat 11, it is ensured during the start, by means of the third control pulse, that a complete forward and backward movement of the sliding seat 11 and hence an initial complete oar-stroke has already taken place.

The evaluation circuit determines further data representing the training output. A counter 51 is provided for determining the total oar-stroke count which counts through a dividing circuit 53 every second control pulse of the sensor 19 occurring at the output of the second stage of the shift register 49. The reading of the counter 51 represents the total stroke count and is displayed numerically in a display field 55 of the display screen 23 (FIG. 1). Since the second control pulse is already fed to the dividing circuit 53 after initiation of the rowing movement, the counter 51 counts the third control pulse as the first oar stroke in step with the start of the training time measuring device 35. The counter 51 therefore counts pairs of control pulses in accordance with the forward and backward movement of the sliding seat 11 executed with each oar stroke.

Between successive control pulses during both the forward and the backward movement of the sliding seat 11 the evaluation circuit determines the time interval required for this by means of a counter 59 counting periodic timing pulses of a timing circuit 57. The counting process is controlled by control pulses generated by the sensor 19 fed to a control input 61. The control pulses reset the counter 59 after its reading representing the time interval between successive control pulses has been transferred to a computing device 63 which converts it into a mathematically inverted value representing the instantaneous oar-stroke rate. The value for the oar-stroke rate is displayed in a display field 65 of the display screen 23 (FIG. 1). The suppressor formed by the shift register 49 suppresses each initial control pulse at the start of training, whereby the calculation of the oar-stroke rate commences with every second control pulse and already at the third control pulse the first resultant value for the oar-stroke count can be included in the display screen 23 simultaneously with the first resultant value for the total stroke count.

If the oar-stroke rate falls below the minimum stroke rate fixed by the switch-off device 45 the training time measuring device 35 is halted and the steady value, i.e. the rate zero, is also displayed by a control input 67 of the display field 65 displaying numerically the oar-stroke rate.

The shift register 49 and the counters 39, 51 and 59 are resettable by means of a reset device 69 operated by the reset button 33. The reset device 69 generates a reset signal R if the reset button 33 is operated for a preset time interval, for example, two seconds. The monitoring of the preset time interval by the reset device 69 prevents an unintentional cancellation of the data stored in the counters 39, 51, 59.

The evaluation circuit explained above is consists of discrete components. The evaluation circuit can naturally, however, also be realized by a micro-processor with a similarly operating program.

Figure 5:
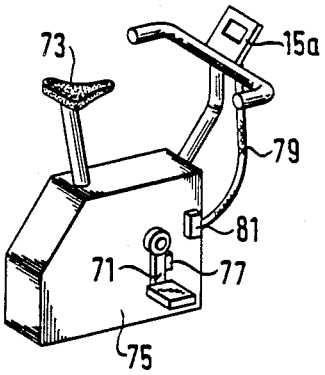
FIG. 5 is a perspective view of a home bicycle with a digital indicating instrument according to the invention which is similar to the indicating instrument of FIGS. 2 to 4.

FIG. 5 shows a another embodiment of a digital indicating instrument 15*a* in combination with a home bicycle or ergometer, in which a braking device not shown in greater detail is driven by pedal cranks 71. The pedal cranks 71 are mounted pivotally in the usual way on a basic frame 75 equipped with a seat 73. One of the pedal cranks 71 bears a magnet 77 which on movement of the crank is passed by a magnetic field sensor 81 connected by a cable 79 to an evaluation circuit not shown in greater detail of the instrument 15*a*. The magnetic field sensor 81 is fixed to the basic frame 75 and generates control pulses to which the evaluation circuit responds, as has been explained above by means of FIGS. 1 to 4. In particular the evaluation circuit comprises an automatically starting and stopping training time measuring device and a further measuring device determining the control pulse rate and hence the pedal turning speed. Both of the mentioned devices can have the circuit explained in accordance with FIG. 4. In order to prevent unintentional starting of the training time measuring device, a device for suppressing the first control pulse generated at the start of training is also provided.

While specific embodiments of the invention have been shown and described in detail to illustrate the application of the inventive principles, it will be understood that the invention may be embodied otherwise without departing from such principles.

What I claim is:

1. A digital indicating instrument for a physical training device having a basic frame on which an operating part to be moved for training purposes is movably guided, comprising:

sensor trip element fixed to the operating part;

sensor means mounted rigidly relative to the basic frame for responding to a passing movement of the sensor trip element and generating control pulses;

evaluation means for responding to the control pulses and producing signals; and display means displaying the signals of the evaluation means, said evaluation means including control means responsive to the control pulses of said sensor means and training time measuring means controllable in a start-stop manner and generating time signals representing training real time, the time signals being displayed by the display means, said training time measuring means being responsive to the control pulses indicating a start of training, said control means stopping said training time measuring means if within a time interval of a preset length an initial control pulse is not succeeded by a further control pulse, said control means suppressing a predetermined number of control pulses in order to delay said training time measuring means for indicating a start of training when said training time measuring means is stopped.

2. A digital indicating instrument according to claim 1, wherein said evaluation means further comprises pulse rate measuring means for generating a signal which is displayed by said display means so as to represent a repetition rate of the control pulses, said control means suppressing a preset number of control pulses generated by the sensor in order to delay the pulse rate measurement when said training time measuring means is stopped.

3. A digital indicating instrument according to claim 2, wherein said control means suppresses each initial control pulse generated by said sensor means for both said training time measuring means and said pulse rate measuring means.

4. A digital indicating instrument according to claim 3, wherein the control means suppresses a second control pulse generated by said sensor means for said training time measuring means, but not for said pulse rate measuring means.

5. A digital indicating instrument according to claim 1, wherein the physical training device is designed as a rowing device having a movably connected seat, said sensor trip element being attached to said seat.

6. A digital indicating instrument according to claim 5, wherein said evaluation means further includes a pulse counter for generating a signal which is displayed by the display means so as to represent a number of control pulse pairs succeeding the present number of control pulse which is suppressed by said control means.

7. A digital indicating instrument according to claim 1, wherein the physical training device is a stationary bicycle having a pedal crank, said sensor trip element being attached to said pedal crank.

8. A digital indicating instrument according to claim 1, wherein the evaluation means further includes reset means for responding to an operation of a reset button in a time interval of a predetermined length to reset said evaluation means for supplying signals to said display means to display.

* * * * *